US010920727B2

(12) United States Patent
Shaull et al.

(10) Patent No.: US 10,920,727 B2
(45) Date of Patent: Feb. 16, 2021

(54) SWIRL INJECTOR PLUNGER

(71) Applicant: CUMMINS INC., Columbus, IN (US)

(72) Inventors: Anthony Shaull, Columbus, IN (US); David L. Buchanan, Westport, IN (US); Lester L. Peters, Columbus, IN (US); Bradlee J. Stroia, West Granby, CT (US); William D. Daniel, Scipio, IN (US)

(73) Assignee: Cummins Inc., Columbus, IN (US)

( * ) Notice: Subject to any disclaimer, the term of this patent is extended or adjusted under 35 U.S.C. 154(b) by 9 days.

(21) Appl. No.: 16/301,497

(22) PCT Filed: May 16, 2016

(86) PCT No.: PCT/US2016/032641
§ 371 (c)(1),
(2) Date: Nov. 14, 2018

(87) PCT Pub. No.: WO2017/200516
PCT Pub. Date: Nov. 23, 2017

(65) Prior Publication Data

US 2019/0293039 A1 Sep. 26, 2019

(51) Int. Cl.
*F02M 61/16* (2006.01)
*B05B 1/34* (2006.01)
(Continued)

(52) U.S. Cl.
CPC ..... *F02M 61/162* (2013.01); *B05B 1/34* (2013.01); *F02M 61/08* (2013.01); *F02M 61/18* (2013.01); *F02M 63/0078* (2013.01)

(58) Field of Classification Search
CPC ..... F02M 61/162; F02M 61/08; F02M 61/18; F02M 63/0078; B05B 1/34
(Continued)

(56) References Cited

U.S. PATENT DOCUMENTS 492,947 A 3/1893 Smith
3,945,574 A 3/1976 Polnauer et al.
(Continued)

FOREIGN PATENT DOCUMENTS

DE 19712590 A1 10/1998
EP 0 218 061 4/1987
FR 1408212 A 8/1965

OTHER PUBLICATIONS

International Search Report and Written Opinion dated Aug. 12, 2016 in PCT/US2016/032641.
(Continued)

*Primary Examiner* — Steven J Ganey
(74) *Attorney, Agent, or Firm* — Faegre Drinker Biddle & Reath LLP

(57) ABSTRACT

A fluid injector assembly extending along a longitudinal axis comprising a housing, and an injector positioned within the housing, the injector comprising a injector body having an interior cavity, a plunger positioned within the interior cavity and comprising a plunger body, a fluid delivery passage along at least a portion of the plunger body, and a plunger tip positioned at a downstream end of the plunger body, the fluid delivery passage comprising a longitudinal passage and at least one internal swirl passage, and the internal swirl passage being angled relative to the longitudinal axis and extending from the longitudinal passage to an opening upstream of the plunger tip, and a nozzle positioned at a downstream end of the injector body and including at least one nozzle passage, fluid being delivered from an upstream end of the injector to the at least one nozzle passage through the fluid delivery passage.

21 Claims, 13 Drawing Sheets

(51) Int. Cl.
*F02M 61/08* (2006.01)
*F02M 61/18* (2006.01)
*F02M 63/00* (2006.01)

(58) Field of Classification Search
USPC ..... 239/468, 487, 488, 533.12
See application file for complete search history.

(56) References Cited

U.S. PATENT DOCUMENTS

| | | | | |
|---|---|---|---|---|
| 4,317,542 | A | 3/1982 | Morishita et al. | |
| 4,365,746 | A | 12/1982 | Tanasawa et al. | |
| 4,575,009 | A | 3/1986 | Giraudi | |
| 4,629,127 | A | 12/1986 | Kawamura et al. | |
| 5,058,549 | A | 10/1991 | Hashimoto et al. | |
| 5,884,850 | A | 3/1999 | Norgauer | |
| 5,996,912 | A | 12/1999 | Ren et al. | |
| 6,079,642 | A | 6/2000 | Maier | |
| 6,209,806 | B1 | 4/2001 | Pace et al. | |
| 6,510,836 | B2 * | 1/2003 | Ismailov ..... | F02D 41/40 239/533.12 |
| 6,789,752 | B2 | 9/2004 | Dantes et al. | |
| 2004/0195388 | A1 | 10/2004 | Astachow et al. | |
| 2011/0253808 | A1 | 10/2011 | Bamber | |

OTHER PUBLICATIONS

European Search Report and Search Opinion Received for EP Application No. 169025681, dated Oct. 22, 2019, 6 pages.
International Preliminary Report on Patentability dated Sep. 24, 2018 in PCT/US2016/032641.

* cited by examiner

SWIRL INJECTOR PLUNGER

RELATED APPLICATIONS

This application is a U.S. National Stage Entry under 35 U.S.C. § 371 of International Patent Application No. PCT/US2016/032641, filed May 16, 2016, the entire disclosure of which is hereby expressly incorporated by reference in its entirety.

TECHNICAL FIELD OF THE DISCLOSURE

The present disclosure relates to a method and apparatus for adjusting the spray of a fluid injector and, more particularly, to a method and apparatus with swirl passages to assist in atomization of a fluid injected from a fluid injector.

BACKGROUND OF THE DISCLOSURE

There is a consistent desire to increase efficiencies in fluid system operations in order to reduce overall fluid consumption. One way to create more efficient operation is the use of atomized fluid because, in fueling applications, atomized fuel lowers fuel consumption and emissions by allowing for a more efficient phase change from a liquid to a vapor due to increased surface area of the fuel and thus greater exposure to heat. In some embodiments, fluid may be atomized by high injection pressure or a combination of high injection pressure and mixing in atomizing air. Additionally, other embodiments may include a wall or deflector and/or may use heat or a surfactant for liquid surface tension depletion to atomize fluids. However, each of these methods requires the use of high pressure or additional components, which may increase the cost or complexity of a fluid injector. Thus, it would be beneficial to provide an apparatus and method to assist in atomizing fluid spray without the use of high pressure or additional components.

SUMMARY OF THE DISCLOSURE

In one embodiment of the present disclosure, a fluid injector assembly extending along a longitudinal axis comprises a housing, and an injector positioned within the housing. The injector comprises an injector body having an interior cavity, a plunger positioned within the interior cavity of the injector body and comprising a plunger body, a fluid delivery passage along at least a portion of the plunger body, and a plunger tip positioned at a downstream end of the plunger body, wherein the fluid delivery passage comprises a longitudinal passage and at least one internal swirl passage, the at least one internal swirl passage being angled relative to the longitudinal axis and extending from the longitudinal passage to an opening upstream of the plunger tip, and a nozzle positioned at a downstream end of the injector body, the nozzle having at least one nozzle passage, wherein fluid is delivered from an upstream end of the injector to the at least one nozzle passage of the nozzle through the fluid delivery passage.

In one aspect of the fluid injector assembly, the at least one internal swirl passage defines a helical fluid passage.

In another aspect of the fluid injector assembly, the at least one internal swirl passage is angled downward relative to the longitudinal axis of the injector assembly.

In another aspect of the fluid injector assembly, the at least one internal swirl passage extends diagonally outward from the longitudinal passage to the opening upstream of the plunger tip.

In a further aspect of the fluid injector assembly, the at least one internal swirl passage has an inlet diameter and an outlet diameter, the outlet diameter being smaller than the inlet diameter.

In another aspect of the fluid injector assembly, the plunger further comprises a head including a retention member configured to inhibit rotation of the plunger during operation of the injector assembly.

In a further embodiment of the present disclosure, a fluid injector comprises an injector body comprising an interior cavity, and a plunger positioned within the interior cavity of the injector body. The plunger includes a fluid delivery passage extending from an upstream end of the plunger to a downstream end of the plunger, and a plunger tip comprising an upstream end and a downstream end, wherein the fluid delivery passage includes an internal longitudinal passage and a plurality of swirl passages, the plurality of swirl passages each extending about an exterior surface of the plunger tip from the upstream end to the downstream end.

In one aspect of the fluid injector, the plurality of swirl passages includes a constant diameter from the upstream end to the downstream end.

In a further aspect of the fluid injector, a diameter of the plurality of swirl passages at the upstream surface of the plunger tip is larger than a diameter of the plurality of swirl passages at the downstream surface of the plunger tip.

In another aspect of the fluid injector, the plurality of swirl passages extend helically about the exterior surface of the plunger tip.

In another embodiment of the present disclosure, a plunger for a fluid injector comprises a head comprising a retention member, a body coupled to the head and extending along a longitudinal axis of the plunger, a tip coupled to the body, and a fluid delivery passage angled relative to the longitudinal axis.

In one aspect of the plunger, the fluid delivery passage includes a first portion positioned within the body and a second portion angled relative to the longitudinal axis.

In another aspect of the plunger, the second portion of the fluid delivery passage is positioned within the body.

In another aspect of the plunger, the second portion of the fluid delivery passage is external to the body at the tip.

In another aspect of the plunger, the second portion of the fluid delivery passage defines a helical flow passage.

In a further aspect of the plunger, the second portion of the fluid delivery passage has an inlet diameter and an outlet diameter, the outlet diameter being smaller than the inlet diameter.

In another aspect of the plunger, the second portion of the fluid delivery passage has a constant diameter.

In a further aspect of the plunger, the retention member comprises at least one protrusion.

In another aspect of the plunger, the retention member comprises at least one flat engagement surface.

In another aspect of the plunger, the plunger further comprises a recessed portion coupled to the body, the tip being coupled to the body through the recessed portion and having a diameter greater than that of the recessed portion, wherein the fluid delivery passage includes a first portion positioned within the body and a second portion angled relative to the longitudinal axis and having an inlet in fluid communication with the first portion and an outlet, at least one of the inlet and the outlet being positioned within the recessed portion.

In another embodiment of the present disclosure, a fluid injector assembly comprises an injector body, a plunger, and a nozzle positioned at a downstream end of the injector body, the nozzle having at least one nozzle passage, wherein fluid is delivered from an upstream end of the injector body to the at least one nozzle passage of the nozzle through the fluid delivery passage. In addition, the plunger comprises a head comprising a retention member, a body coupled to the head and extending along a longitudinal axis of the plunger, a tip coupled to the body, and a fluid delivery passage angled relative to the longitudinal axis.

BRIEF DESCRIPTION OF THE DRAWINGS

Advantages and features of the embodiments of this disclosure will become more apparent from the following detailed description of exemplary embodiments when viewed in conjunction with the accompanying drawings, wherein.

Figure 2:
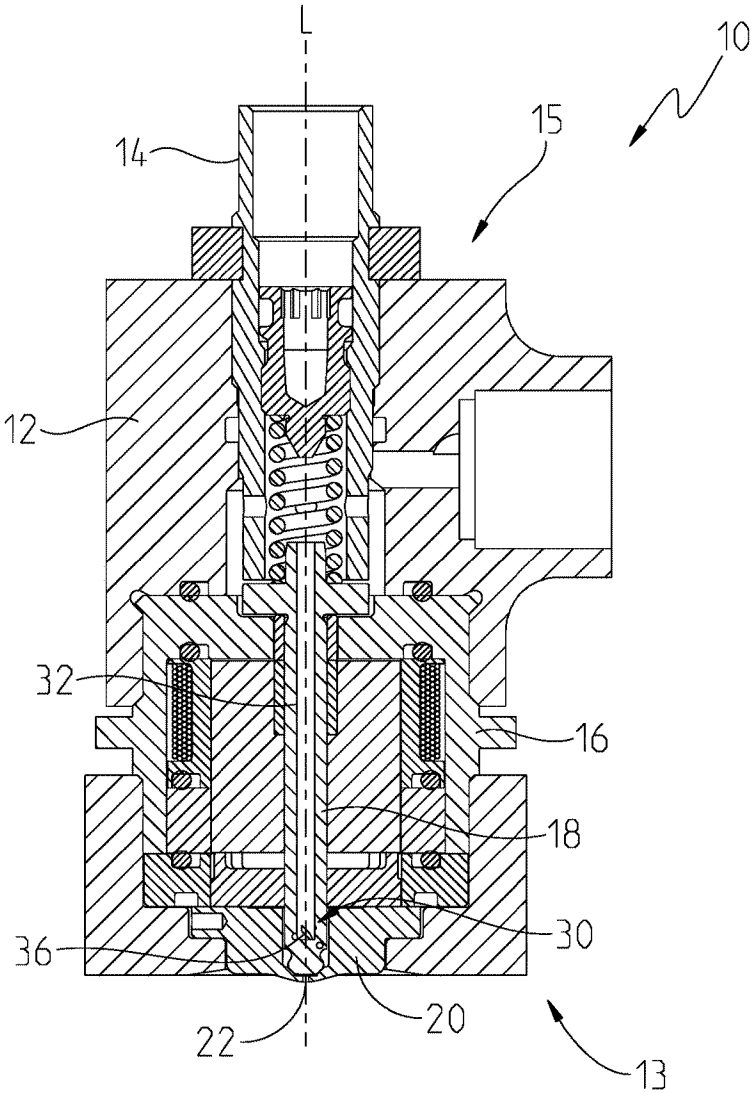
FIG. 2 is a cross-sectional view of the fluid injector assembly of FIG. 1 taken along line 2-2 of FIG. 1.

Corresponding reference characters indicate corresponding parts throughout the several views. Although the drawings represent embodiments of the present disclosure, the drawings are not necessarily to scale and certain features may be exaggerated in order to better illustrate and explain the present disclosure. The exemplifications set out herein illustrate embodiments of the disclosure, in one form, and such exemplifications are not to be construed as limiting the scope of the disclosure in any manner.

DETAILED DESCRIPTION OF THE DRAWINGS

Figure 1:
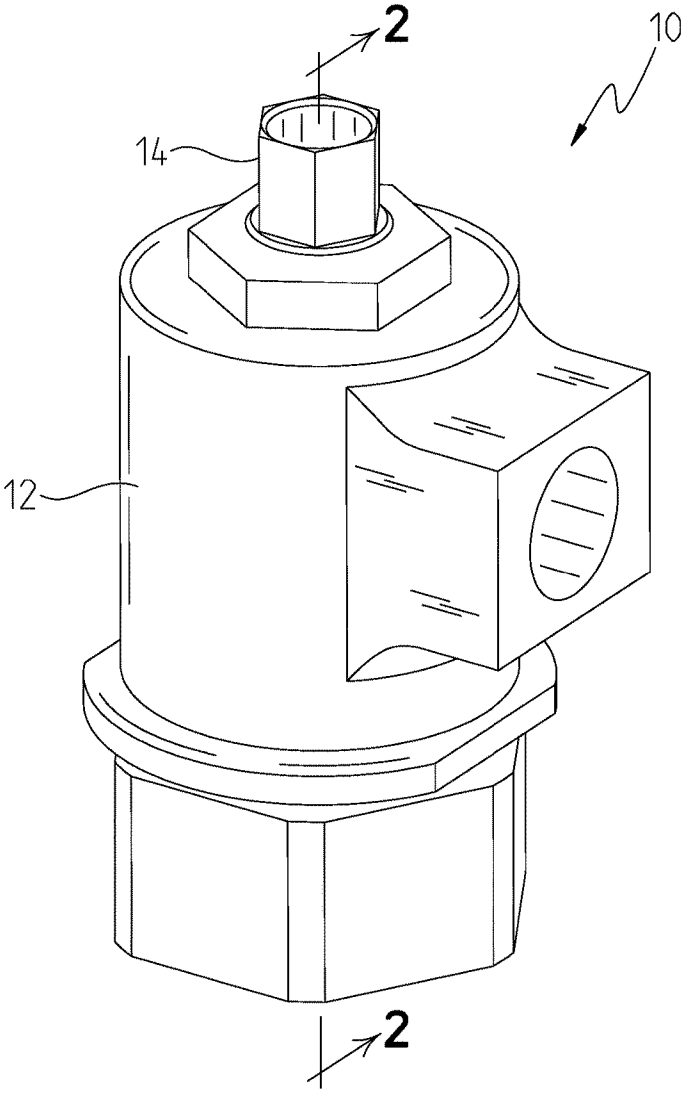
FIG. 1 is a perspective view of an embodiment of a fluid injector assembly of the present disclosure.
Figure 3:
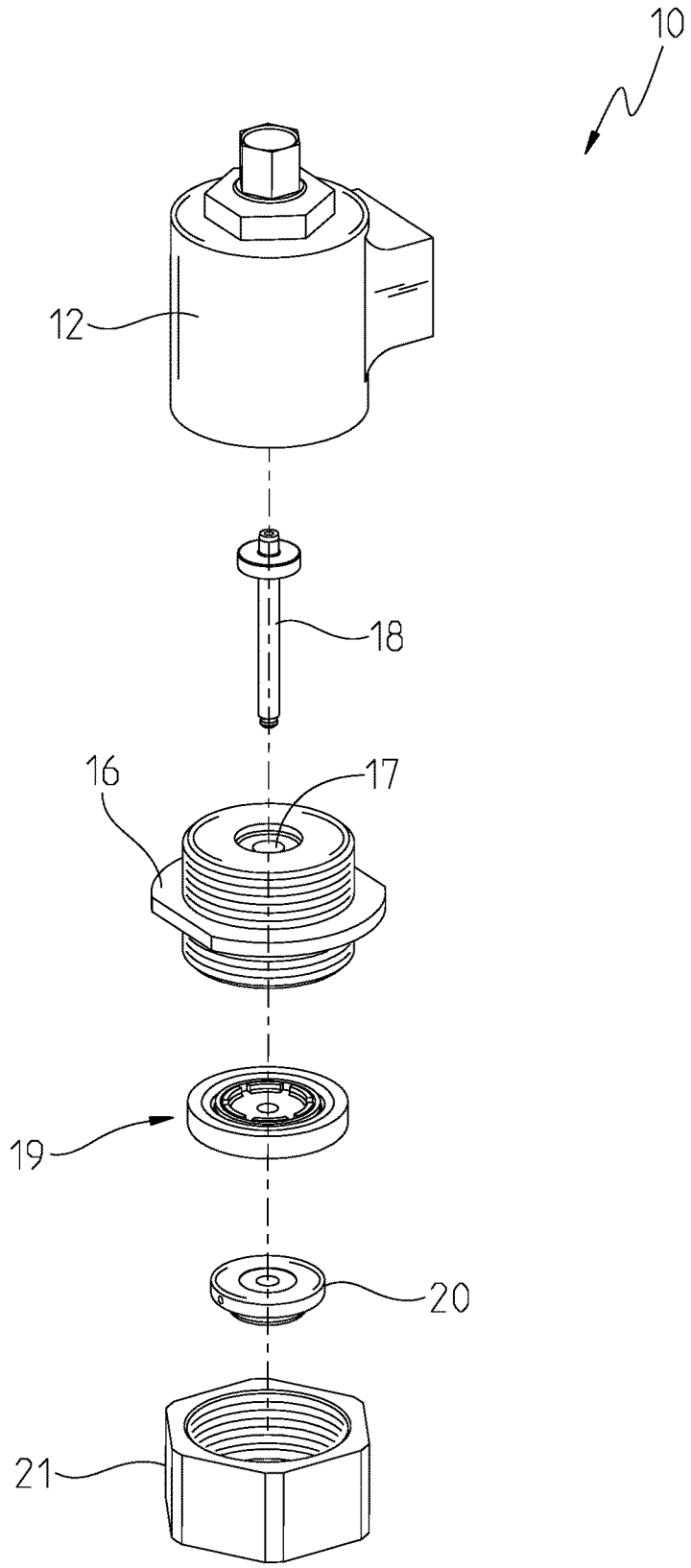
FIG. 3 is an exploded view of the fluid injector assembly of FIG. 1.

Referring to FIGS. 1-3, a fluid injector assembly 10 generally includes a housing 12 and an injector 14 positioned within housing 12. Additionally, in various embodiments, injector 14 generally includes an injector body 16 with an interior cavity 17, a plunger 18 positioned within interior cavity 17, a nozzle 20 positioned at a downstream end 13 of injector body 16, a shim assembly 19 positioned longitudinally below injector body 16 and above nozzle 20, and a retainer 21 coupled to injector body 16 housing nozzle 20 and shim assembly 19. Nozzle 20 generally includes at least one nozzle passage 22, through which fluid from an upstream end 15 of injector 14 may be delivered to a particular application. In various embodiments, nozzle 20 may be coupled to or within downstream end 13 of injector body 16. Illustratively, fluid injector assembly 10 is a water injector assembly, however, fluid injector assembly 10 may be any type of fluid injector configured to deliver a plurality of fluids (e.g., fuel, water, urea, acid, etc.) to another component (e.g., combustion system, exhaust aftertreatment system, etc.).

Figure 4:
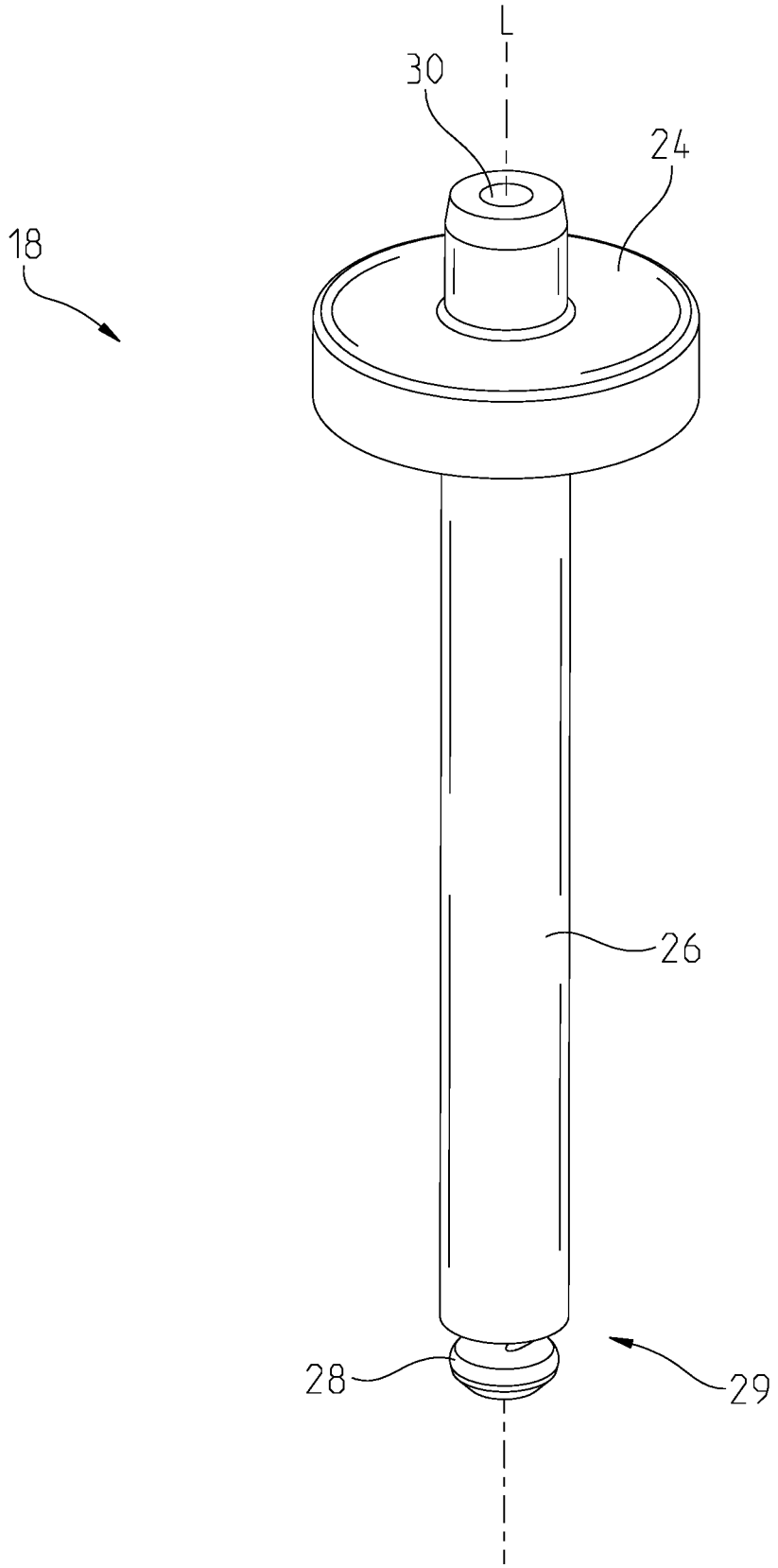
FIG. 4 is a perspective view of an embodiment of a plunger of the fluid injector assembly of FIG. 1.
Figure 12:
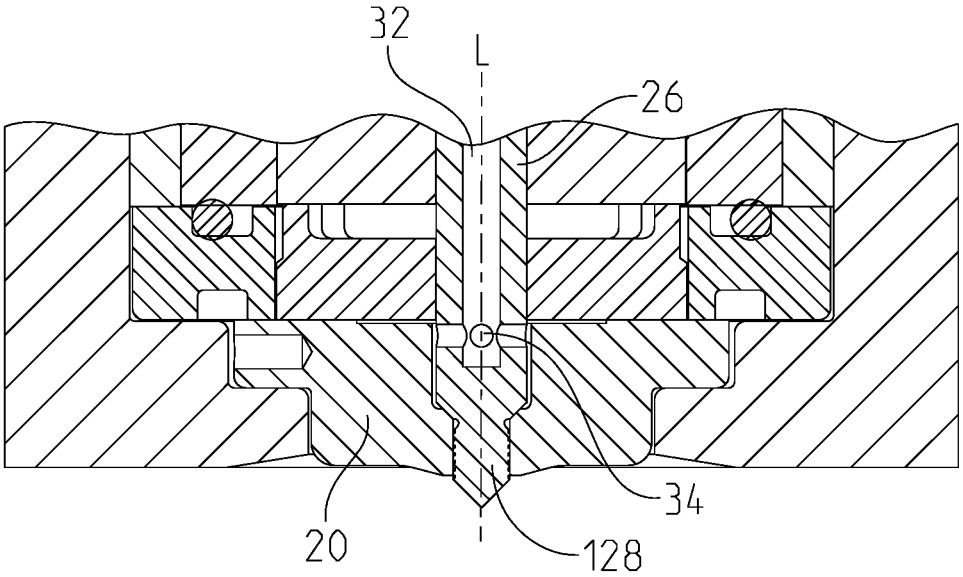
FIG. 12 is a cross-sectional view of a downstream portion of an alternative embodiment of the fluid injector of FIG. 1.
Figure 13:
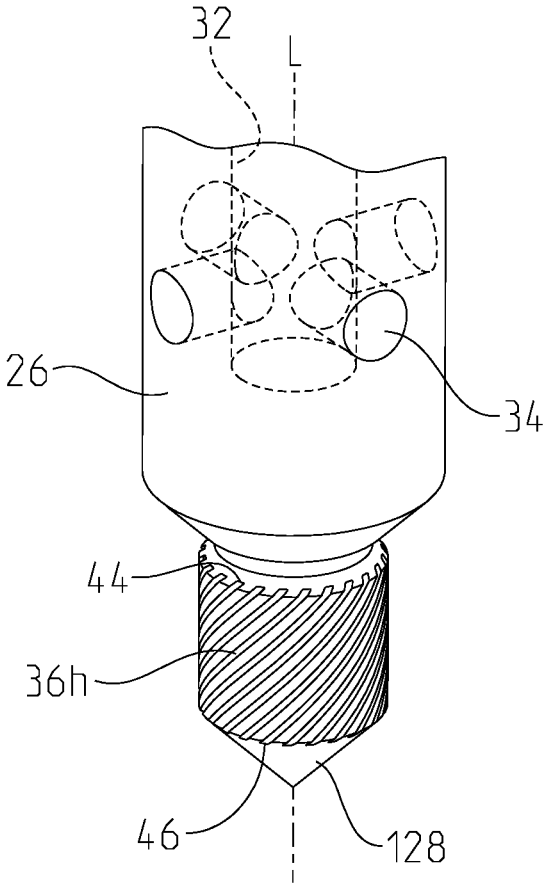
FIG. 13 is a perspective view of an alternative embodiment of the plunger of FIG. 4.
Figure 14:
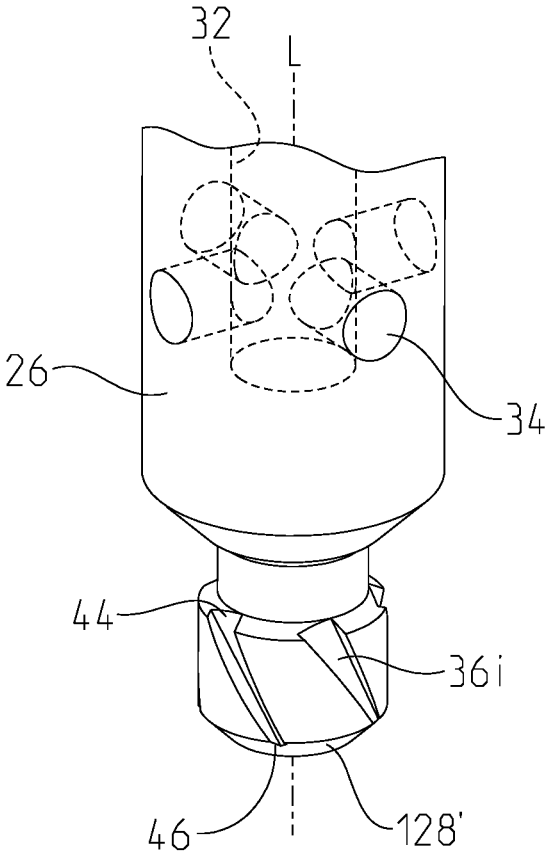
FIG. 14 is a perspective view of a further alternative embodiment of the plunger of FIG. 4.

Referring now to FIGS. 2-4, plunger 18 generally includes a head 24, a plunger body 26 coupled to head 24 and extending along a longitudinal axis L of plunger 18 (FIG. 4), a tip 28 coupled to a downstream end 29 of plunger body 26, and at least one fluid delivery passage 30. Fluid delivery passage 30 may be positioned internally and/or externally on plunger 18. For example, fluid delivery passage 30 may include a first portion shown as a longitudinal passage 32, a second portion shown as at least one horizontal passage 34 (FIG. 12) and/or a third portion shown as at least one swirl passage 36. In general, at least a portion of fluid delivery passage 30 is angled relative to longitudinal axis L. In various embodiments, at least one swirl passage 36 may be internal within plunger body 26. Alternatively, in various embodiments, at least one swirl passage 36 may be external at tip 28 of plunger 18 (FIGS. 12-14). Additionally, in various embodiments, swirl passage 36 may be both internal within plunger body 26 and external at tip 28.

Referring to FIGS. 5-11, fluid delivery passage 30 may include longitudinal passage 32 and at least one swirl passage 36 internal within plunger body 26. In various embodiments, longitudinal passage 32 may extend downward into tip 28. Illustratively, longitudinal passage 32 may include a frustoconical end 33 (FIG. 8A) positioned near or within tip 28. Furthermore, swirl passage(s) 36 generally extends from an inlet opening 40 fluidly coupled to longitudinal passage 32 to an outlet opening 38 upstream of tip 28 and open to the exterior of plunger body 26. In various embodiments, outlet opening 38 may be positioned within a recess or groove 27 at downstream end 29 of plunger body 26 upstream of tip 28. Outlet opening 38 and/or inlet opening 40 may be of a variety of shapes including circular, oval, or any other shape configured to allow a fluid to flow into and out of swirl passage 36. In addition, swirl passage(s) 36 may include a plurality of different configurations between inlet opening 40 and outlet opening 38. For instance, swirl passage 36 may extend linearly, helically, diagonally or in any other configuration between inlet opening 40 and outlet opening 38 to allow flow of a fluid flowing there through. When fluid delivery passage 30 includes more than one swirl passage 36, outlet openings 38 and/or inlet openings 40 of passages 36 may be evenly spaced apart in various embodiments, or spaced in such a way as to promote swirl around tip 28, as disclosed further herein.

Figure 5A:
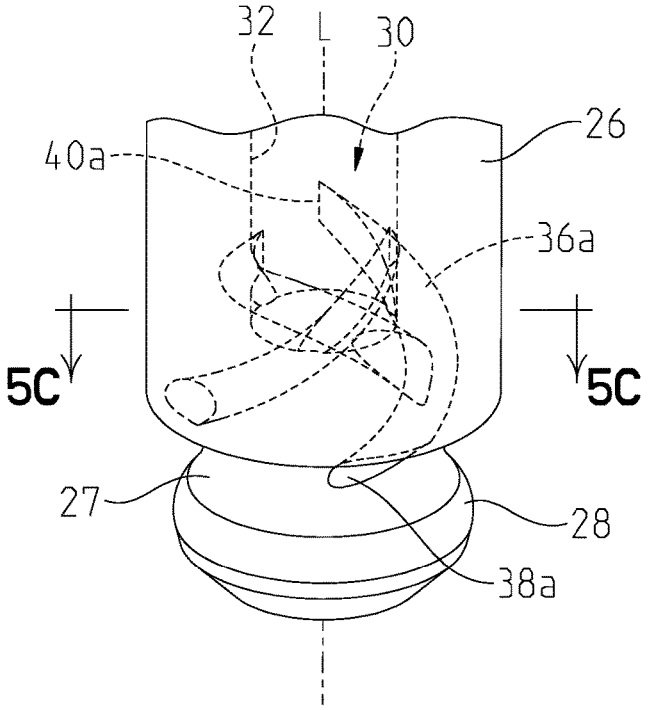
FIG. 5A is a perspective view of an embodiment of the plunger of FIG. 4 having at least one fluid delivery passage.
Figure 5B:
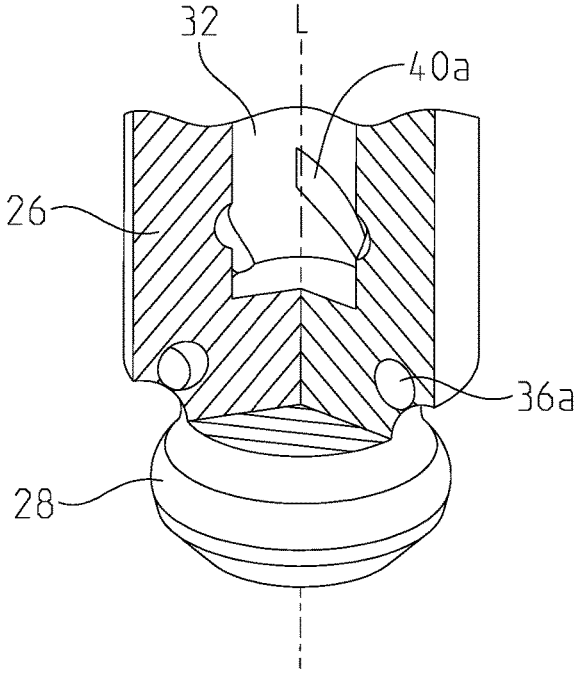
FIG. 5B is a cross-sectional view of the plunger and the fluid delivery passage of FIG. 5A.
Figure 5C:
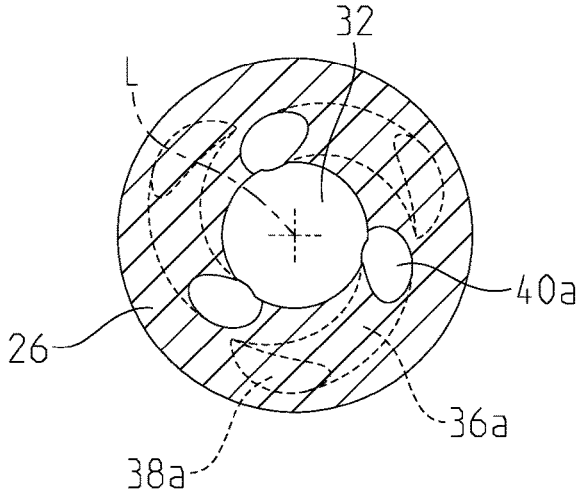
FIG. 5C is a cross-sectional view of the plunger of FIG. 5A taken along line 5C-5C of FIG. 5A.

Referring to FIGS. 5A-5C, in one embodiment, fluid delivery passage 30 includes swirl passages 36*a* which may be helical, and extend downward from an inlet opening 40*a* outward at an angle relative to longitudinal axis L of plunger 18. In various embodiments, fluid delivery passage 30 may include three swirl passages 36*a*. Additionally, in various embodiments, swirl passages 36*a* may be equally spaced apart from each other. In an illustrative embodiment, when fluid delivery passage 30 includes three swirl passages 36*a*, outlet openings 38*a* of swirl passages 36*a* are approximately 120 degrees apart from each other.

Figure 6A:
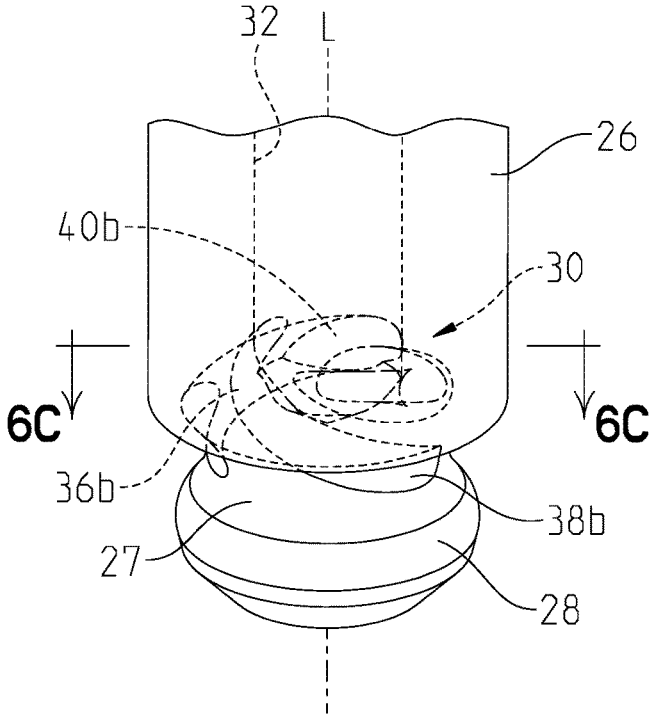
FIG. 6A is a perspective view of an alternative embodiment of the plunger of FIG. 4.
Figure 6B:
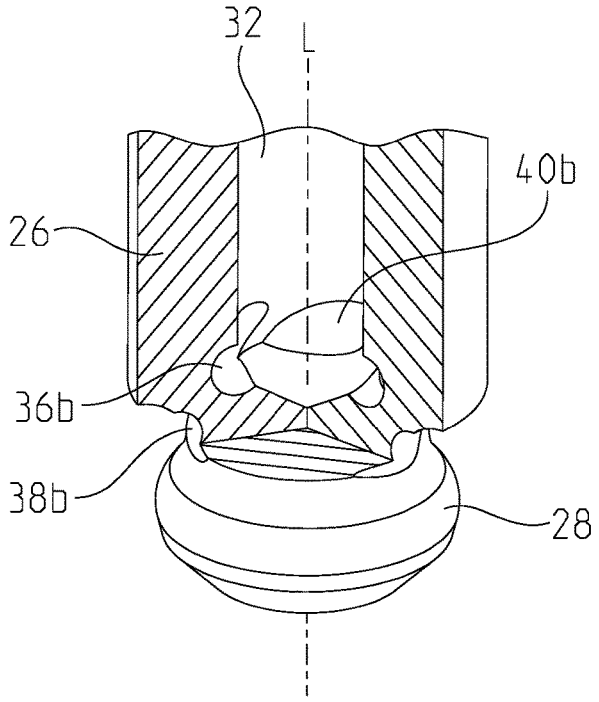
FIG. 6B is a cross-sectional view of the plunger of FIG. 6A.
Figure 6C:
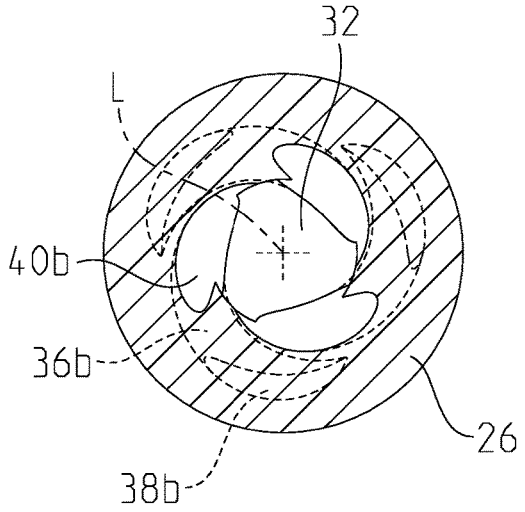
FIG. 6C is a cross-sectional view of the plunger of FIG. 6A taken along line 6C-6C of FIG. 6A.

Referring to FIGS. 6A-6C, in another embodiment, fluid delivery passage 30 includes swirl passages 36*b* which may be helical, and extend downward from an inlet opening 40*b* outward at an angle relative to longitudinal axis L of plunger 18. In various embodiments, fluid delivery passage 30 may include three swirl passages 36*b*. Furthermore, in various embodiments, swirl passages 36*b* may be spaced closer together than swirl passages 36*a* such that swirl passages 36*b* do not extend as far longitudinally as swirl passages 36*a*. In an illustrative embodiment, when fluid delivery passage 30 includes three swirl passages 36*b*, outlet openings 38*b* of swirl passages 36*b* are approximately 120 degrees apart from each other.

Figure 7A:
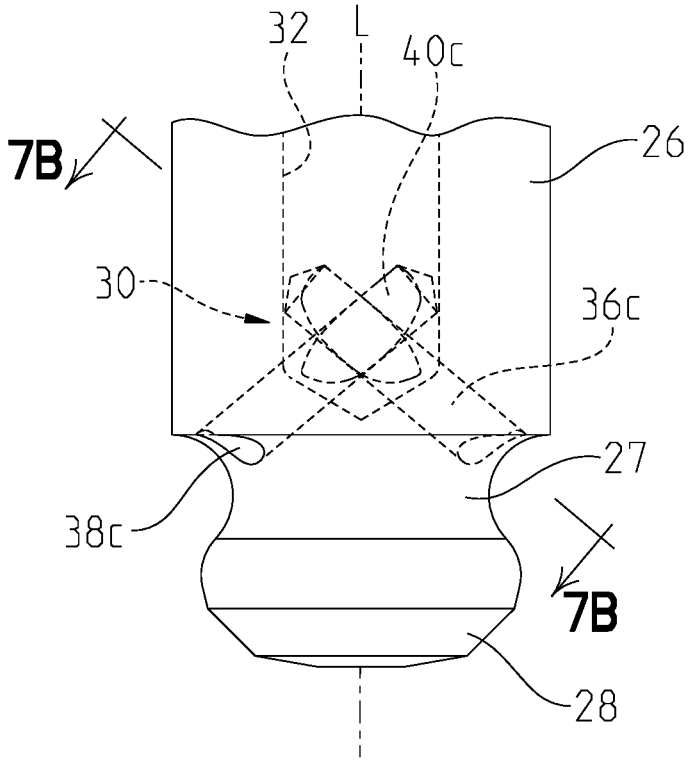
FIG. 7A is a perspective view of an alternative embodiment of the plunger of FIG. 4.
Figure 7B:
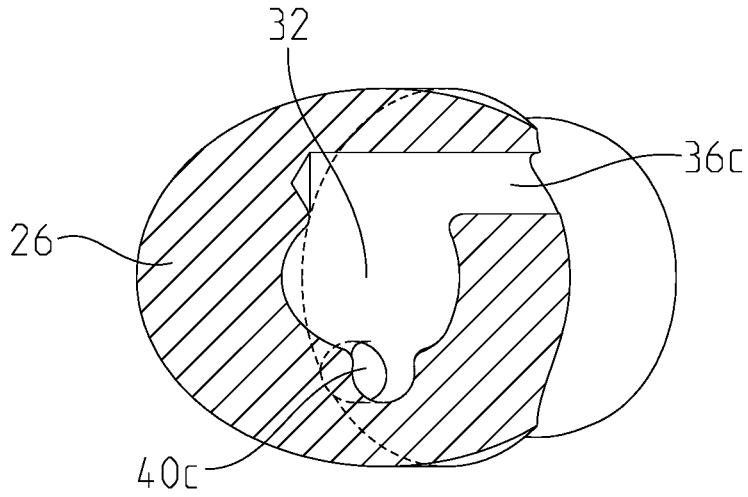
FIG. 7B is a cross-sectional view of the plunger of FIG. 7A taken along line 7B-7B of FIG. 7A.

Referring now to FIGS. 7A-7C, in one embodiment, fluid delivery passage 30 includes swirl passages 36*c* which may extend diagonally outward and downward relative to longitudinal axis L from an inlet opening 40*c*. In various embodiments, fluid delivery passage 30 may include two diagonal passages 36*c*, such that passages 36*c* may be substantially perpendicular to each other such that inlet openings 40*c* and outlet openings 38*c* of swirl passages 36*c* are positioned on opposite sides of longitudinal axis L of plunger 18. In an exemplary embodiment, outlet openings 38*c* of passages 36*c* are approximately 180 degrees spaced apart.

Figure 8A:
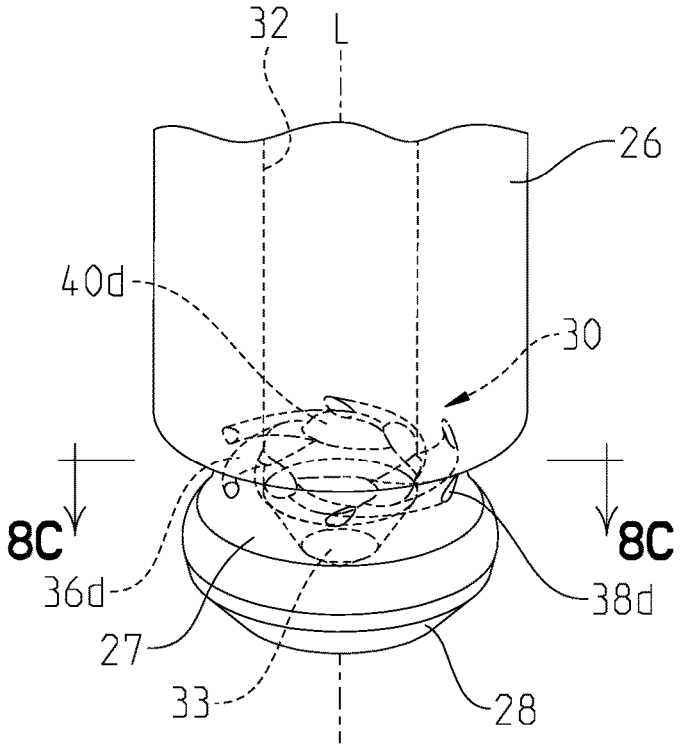
FIG. 8A is a perspective view of an alternative embodiment of the plunger of FIG. 4.
Figure 8B:
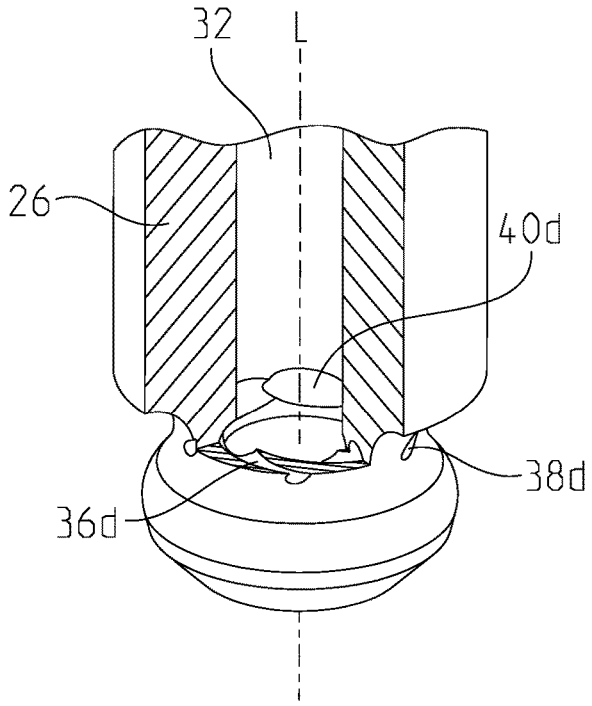
FIG. 8B is a cross-sectional view of the plunger of FIG. 8A.
Figure 8C:
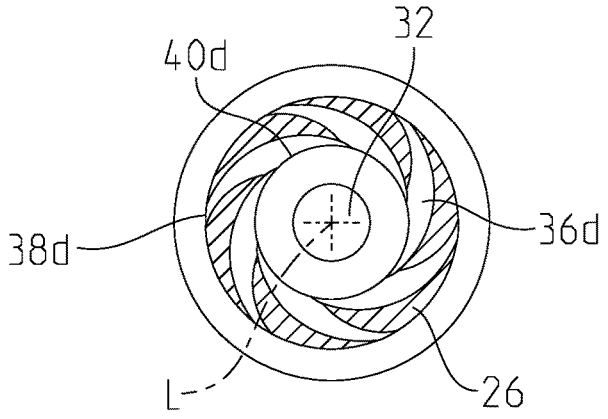
FIG. 8C is a cross-sectional view of the plunger of FIG. 8A taken along line 8C-8C of FIG. 8A.

With reference to FIGS. 8A-8C, in a further embodiment, fluid delivery passage 30 includes swirl passages 36*d* which extend helically in a radially outward direction relative to longitudinal axis L from an inlet opening 40*d* fluidly coupled to longitudinal passage 32. Inlet opening 40*d* has a first diameter and an outlet opening 38*d* of swirl passage 36*d* has a second diameter. In various embodiments, the second diameter of outlet opening 38*d* may be smaller than the first diameter of inlet opening 40*d*, while in other various embodiments, the first and second diameters of openings 40*d*, 38*d* are substantially equal or the first diameter of inlet opening 40*d* is smaller than the second diameter of outlet opening 38*d*. In an illustrative embodiment, fluid delivery passage 30 includes six swirl passages 36*d*. As shown in FIGS. 8A-8C, outlet openings 38*d* of swirl passages 36*d* are approximately 60 degrees apart from each other when fluid delivery passage 30 includes six swirl passages 36*d*.

Figure 9A:
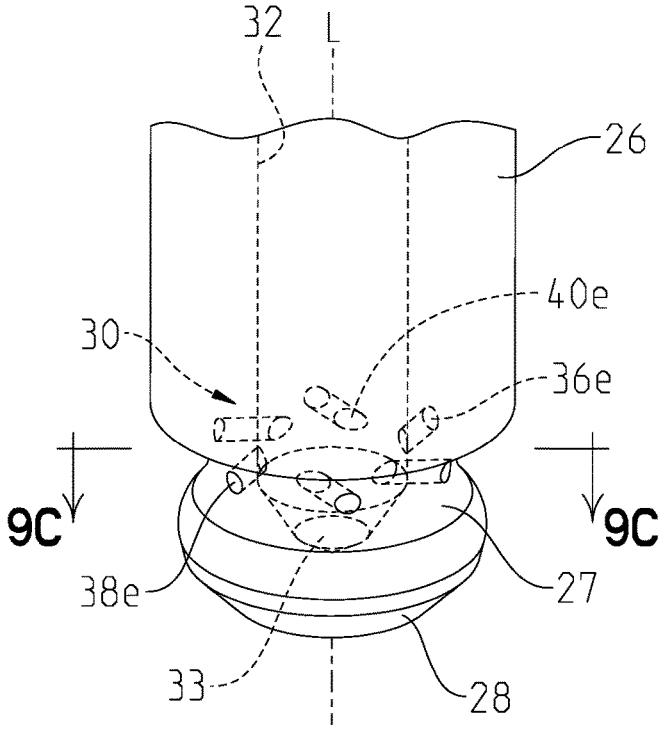
FIG. 9A is a perspective view of an alternative embodiment of the plunger of FIG. 4.
Figure 9B:
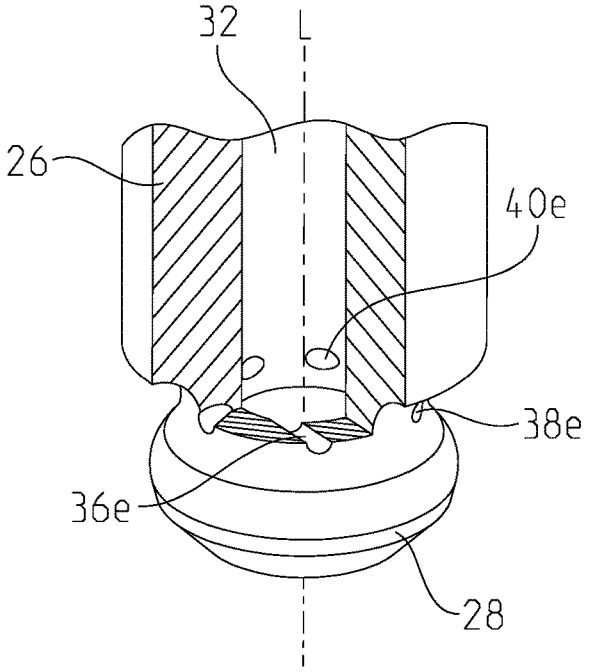
FIG. 9B is a cross-sectional view of the plunger of FIG. 9A.
Figure 9C:
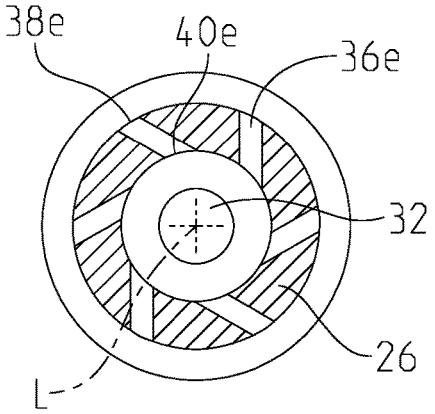
FIG. 9C is a cross-sectional view of the plunger of FIG. 9A taken along line 9C-9C of FIG. 9A.

Referring to FIGS. 9A-9C, in one embodiment, fluid delivery passage 30 includes swirl passages 36*e* which extend diagonally outward at an angle relative to longitudinal axis L from inlet openings 40*e* fluidly coupled to longitudinal passage 32 to outlet openings 38*e*. In various embodiments, swirl passages 36*e* may have a constant diameter extending from inlet openings 40*e* to outlet openings 38*e*. Additionally, in an illustrative embodiment, fluid delivery passage 30 includes six swirl passages 38*e*. Furthermore, as shown in FIGS. 9A-9C, outlet openings 38*e* of swirl passages 36*e* are approximately 60 degrees apart from each other when fluid delivery passage 30 includes six passages 36*e*.

Figure 10A:
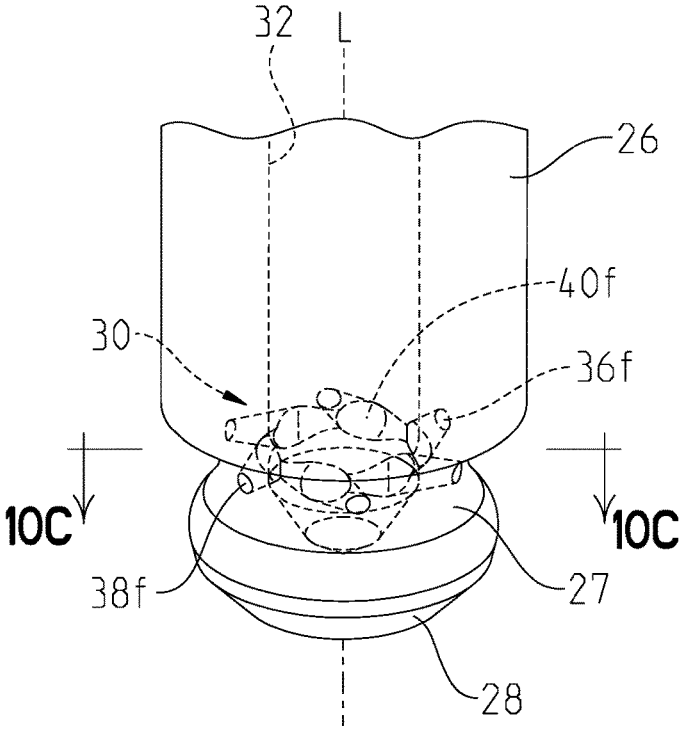
FIG. 10A is a perspective view of an alternative embodiment of the plunger of FIG. 4.
Figure 10B:
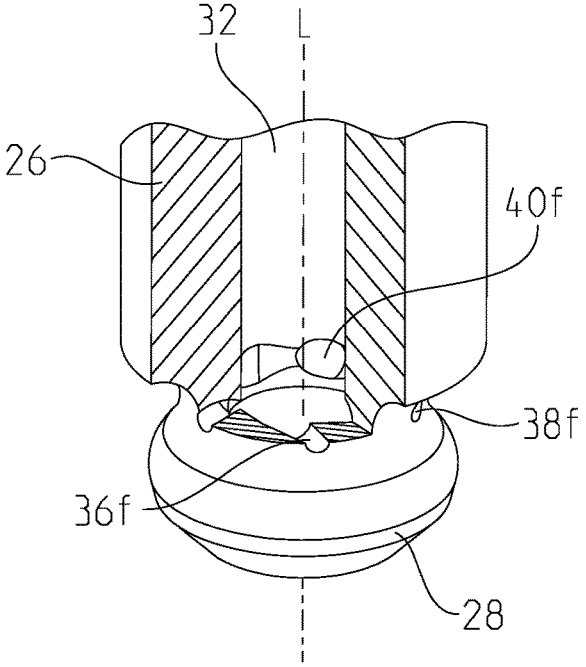
FIG. 10B is a cross-sectional view of the plunger of FIG. 10A.
Figure 10C:
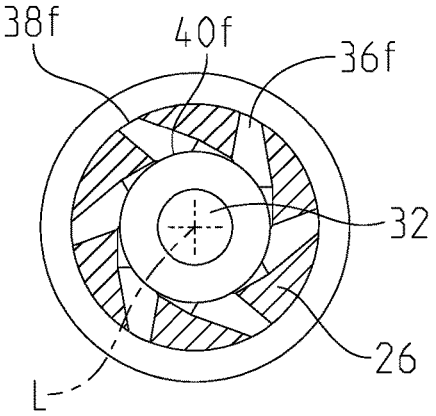
FIG. 10C is a cross-sectional view of the plunger of FIG. 10A taken along line 10C-10C of FIG. 10A.

Referring now to FIGS. 10A-10C, in another embodiment, fluid delivery passage 30 includes swirl passages 36*f* which extend diagonally outward at an angle relative to longitudinal axis L from inlet openings 40*f* fluidly coupled to longitudinal passage 32 to outlet openings 38*f*. In various embodiments, passages 36*f* may include a diameter of inlet opening 40*f* that is larger than a diameter of outlet opening 38*f* Furthermore, in an illustrative embodiment, passages 36*f* gradually decrease in diameter from inlet opening 40*f* to outlet opening 38*f*. Additionally, as shown in FIGS. 10A-10C, fluid delivery passage 30 includes six swirl passages 36*f*. In various embodiments, outlet openings 38*f* of swirl passages 36*f* may be spaced apart from each other approximately 60 degrees when fluid delivery passage includes six swirl passages 36*f*.

Figure 11A:
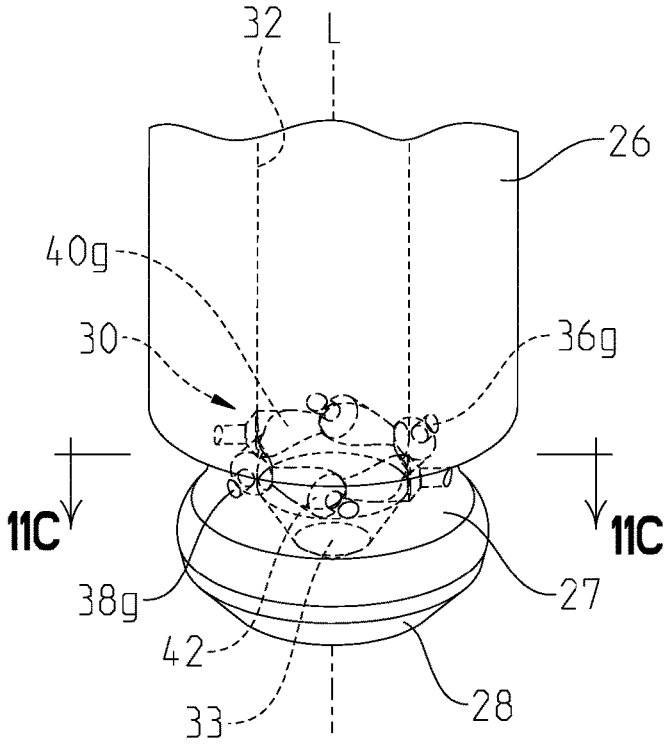
FIG. 11A is a perspective view of an alternative embodiment of the plunger of FIG. 4.
Figure 11B:
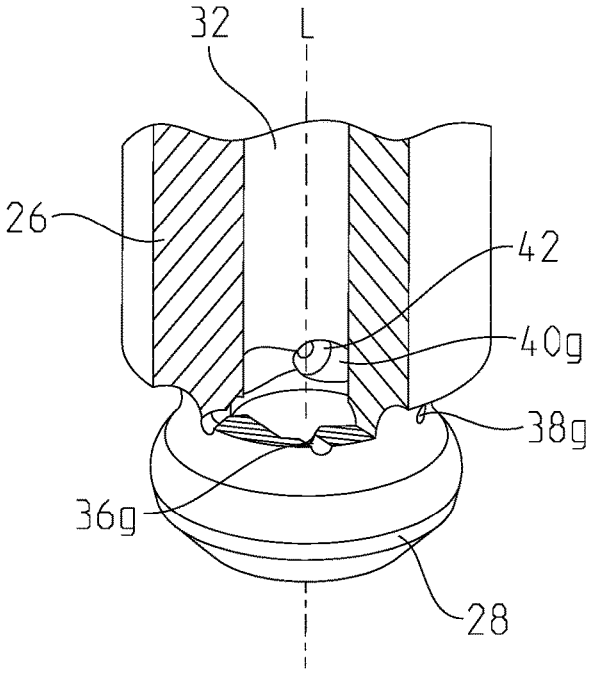
FIG. 11B is a cross-sectional view of the plunger of FIG. 11A.
Figure 11C:
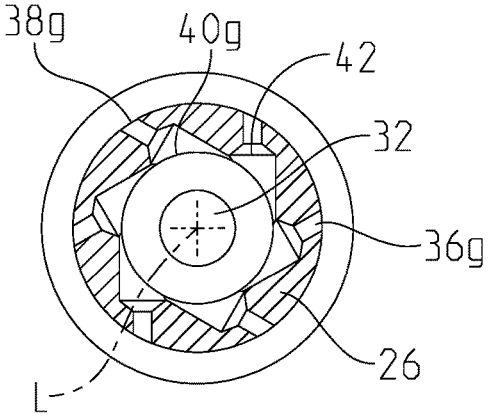
FIG. 11C is a cross-sectional view of the plunger of FIG. 11A taken along line 11C-11C of FIG. 11A.

With reference to FIGS. 11A-11C, in a further embodiment, fluid delivery passage 30 includes swirl passages 36*g* which extend diagonally outward at an angle relative to longitudinal axis L from inlet openings 40*g* fluidly coupled to longitudinal passage 32 to outlet openings 38*g* which open to the exterior of plunger body 26. In various embodiments, swirl passages 36*g* may include a bore 42, which allows the diameter of swirl passage 36*g* to decrease quickly across bore 42 positioned between inlet opening 40*g* and outlet opening 38*g*. In an illustrative embodiment, fluid delivery passage 30 includes six swirl passages 36*g*, which may allow outlet openings 38*g* to be spaced apart approximately 60 degrees from each other. Furthermore, in various embodiments, outlet openings 38*g* may be positioned within recess or groove 27.

Referring now to FIGS. 12-14, alternatively, fluid delivery passage 30 may include longitudinal passage 32 and at least one horizontal passage 34. Horizontal passage 34 is generally fluidly coupled to longitudinal passage 32 and may extend radially outward from longitudinal passage 32. In an illustrative embodiment, fluid delivery passage 30 may include four horizontal passages 34 extending radially outward from longitudinal passage 32 to the exterior of plunger body 26.

Additionally, as shown in FIGS. 12-14, swirl passage 36 may be external and positioned at tip 28, rather than positioned internally within a portion of plunger body 26, as shown in FIGS. 2-11C. For example, at least one swirl passage 36 may be external at tip 128 and angled relative to longitudinal axis L. More specifically, in various embodiments, swirl passage 36 may be angled diagonally and downward relative to longitudinal axis L. Additionally, in various embodiments, plunger body 26 may include tip 128 which is a cone or point, rather than rounded like tip 28 (FIG. 4). Furthermore, tip 128' may be substantially rounded or flat. Swirl passage(s) 36 about tip 128 may be configured in several different arrangements, as disclosed further herein.

For instance, referring to FIG. 13, tip 128 may include a plurality of swirl passages 36*h* about its outer surface which are fluidly coupled to longitudinal passage 32 and/or horizontal passages 34 that may be evenly spaced apart and extend from an upstream surface or end 44 of tip 128 to a downstream surface or end 46 of tip 128. In an illustrative embodiment, passages 36*h* have a constant diameter from upstream surface 44 to downstream surface 46.

With reference to FIG. 14, tip 128 may include a plurality of swirl passages 36*i* about its outer surface which are fluidly coupled to horizontal passages 34 that extend from upstream surface 44 of tip 128 to downstream surface 46 of tip 128 and may be evenly spaced about tip 128. In an illustrative embodiment, swirl passages 36*i* include a larger diameter near upstream surface 44 and a smaller diameter near downstream surface 46.

In operation, fluid is passed through longitudinal passage 32 within plunger body 18 and into at least one swirl passage 36 such that fluid leaving swirl passage(s) 36, both internal and external, has obtained a centripetal acceleration due to the angled configuration of swirl passages 36. As the fluid flows downward to the tip of nozzle 20, conservation of angular momentum forces the swirl velocity of the exiting fluid to increase. Upon reaching nozzle passage 22, the swirling velocity may be at a maximum for its injection condition. This increased swirling velocity results in rapid atomization of the fluid, thus producing smaller droplets when the fluid leaves fluid injection assembly 10. The quick production of the smaller droplets increases the fluid efficiency and lowers emissions by allowing for a more efficient phase change from liquid to vapor due to the fluid having an increased number of droplets and thus increased surface area exposed, which, overall, exposes the fluid to greater heat.

However, the creation of this swirl velocity may also tend to cause plunger 18 to rotate within housing 12. The rotation of plunger 18 may result in a loss of angular momentum of the fluid, which may decrease atomization droplet size and thus fluid efficiency. Thus, a retention member 48, as described further herein, may be used to resist this rotation of plunger 18 to maintain the desired fluid efficiency.

Referring now to FIGS. 15-18, head 24 of plunger 18 and/or injector body 16 may include retention member 48 to prevent rotation of plunger 18 within injector body 16. In order to prevent rotation, injector body 16 includes an opening 50 corresponding to plunger head 24 and retention member 48. Opening 50 is generally shaped similarly to head 24 and retention member 48 such that head 24 and retention member 48 may be received within opening 50. In the illustrative embodiment of FIG. 15, retention member 48 may be a retention member 48*a* defined as a pin, dowel, rod, shaft, or any other generally linear member configured to be received within an opening 60 on plunger 18 and a corresponding opening 62 on injector body 16. Furthermore, opening 50*a* corresponds to plunger head 24 and retention member 48 such that plunger head 24 may fit within opening 50*a* and retention member 48*a* may extend through opening 60 in plunger head 24 into opening 62 on injector body 16. In various embodiments, head 24 and/or injector body 16 may include two retention members 48 each including retention member 48*a*, opening 60 and opening 62. In one embodiment, the two retention members 48 may be spaced approximately 180 degrees apart from each other about head 24.

Figure 16:
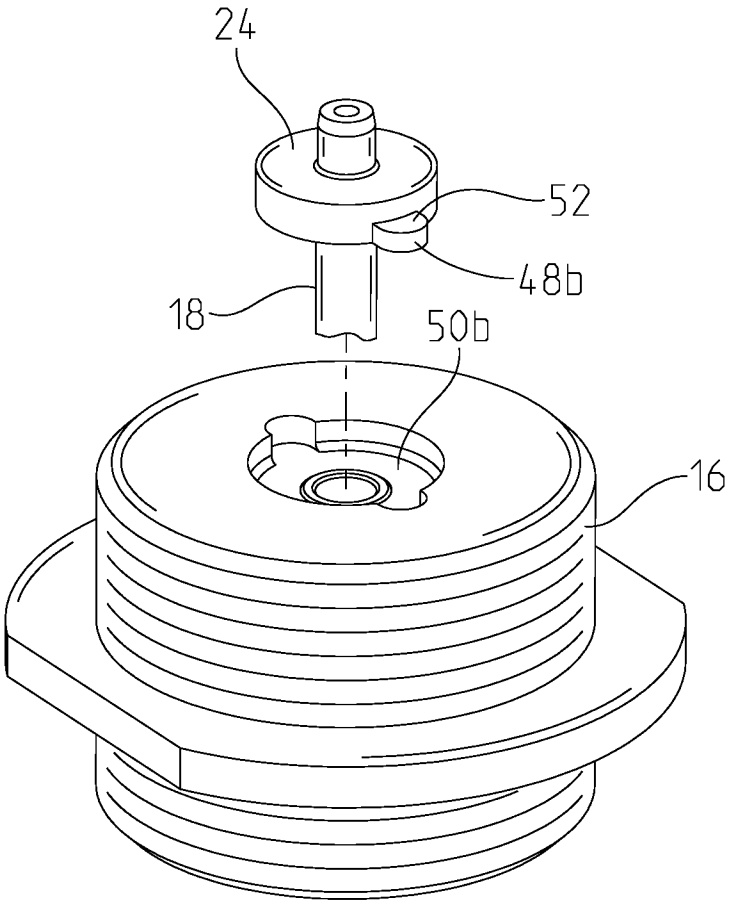
FIG. 16 is a perspective view of an alternative embodiment of the portion of the fluid injector, the plunger, and the retention member of FIG. 15.
Figure 15:
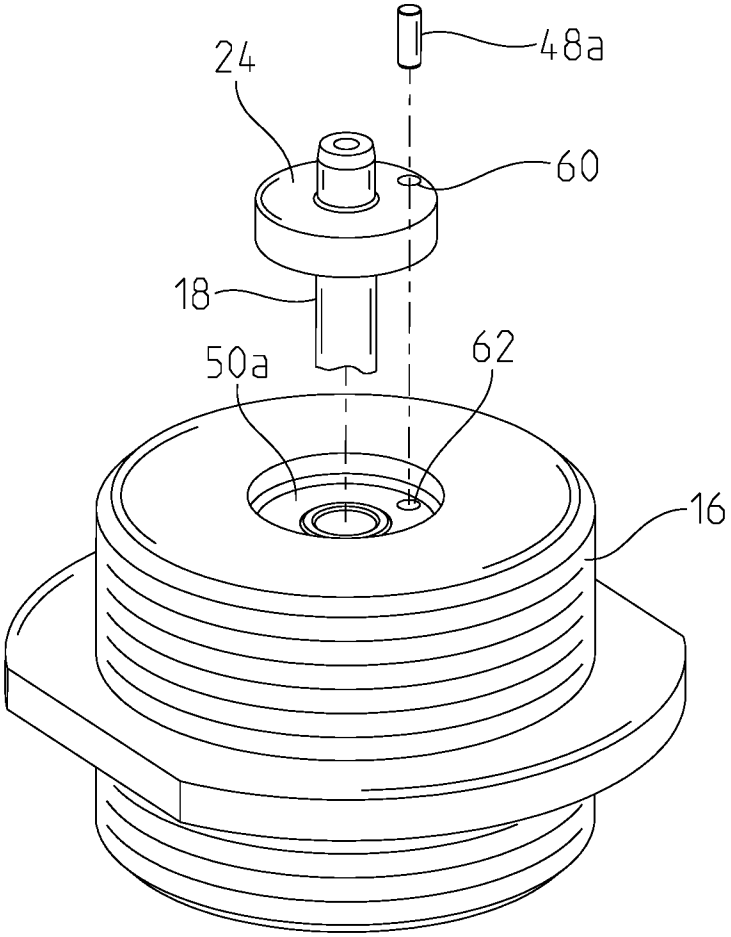
FIG. 15 is a perspective view of a portion of the fluid injector of FIG. 1 configured to retain a head of a plunger therein with a retention member.

Additionally, as shown in FIG. 16, in one embodiment, retention member 48 is shown as retention member 48*b* which includes at least one protrusion or flange 52. In an illustrative embodiment, retention member 48*b* includes two protrusions 52 spaced approximately 180 degrees apart about the circumference of head 24. Protrusions 52 of retention member 48*b* may be of any shape capable of resisting rotation against a corresponding opening 50*b* of injector body 16. In an illustrative embodiment, protrusion (s) 52 of retention member 48*b* are round, or more specifically, semi-circular.

Figure 17:
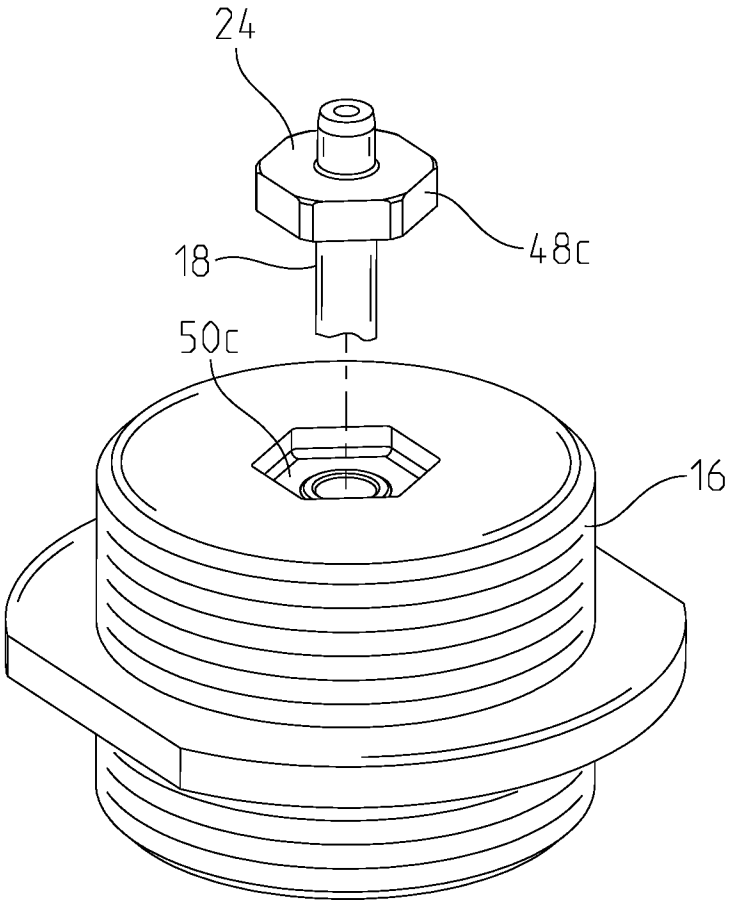
FIG. 17 is a perspective view of another alternative embodiment of the portion of the fluid injector, the plunger, and the retention member of FIG. 15.

Referring to FIG. 17, in another embodiment, retention member 48 is shown as retention member 48*c* which includes at least one flat engagement surface. In one illustrative embodiment, retention member 48*c* includes six flat engagement surfaces defining a hexagonal circumference about head 24. Furthermore, plunger body 16 includes an opening 50*c* that is shaped similarly to the hexagonal circumference of head 24 such that head 24 and retention member 48*c* may be received within opening 50*c* of injector body 16.

Figure 18:
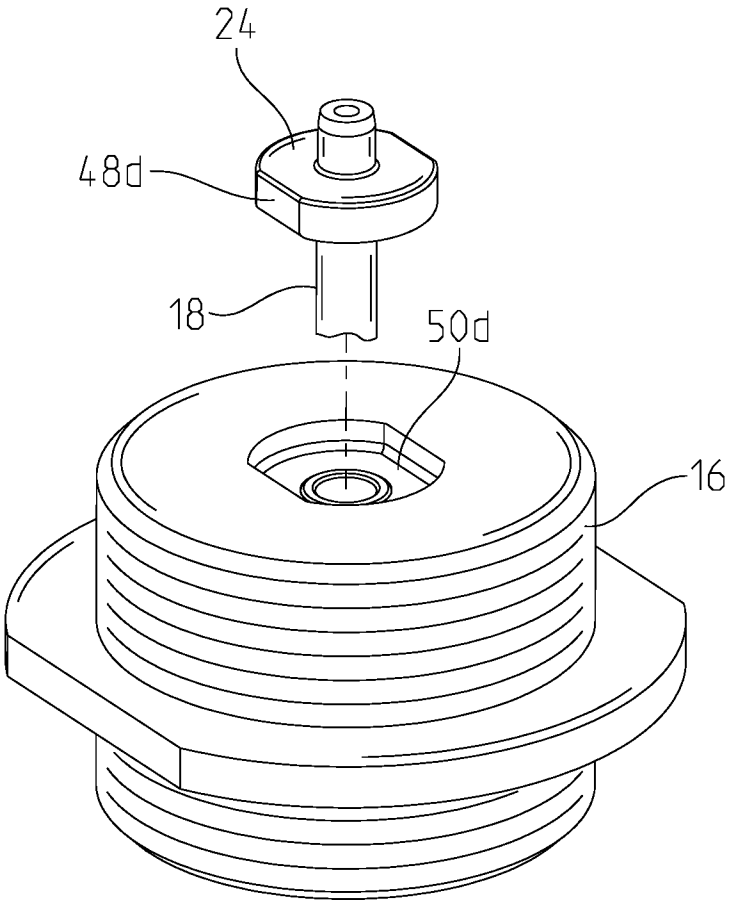
FIG. 18 is a perspective view of a further alternative embodiment of the portion of the fluid injector, the plunger, and the retention member of FIG. 15.

With reference to FIG. 18, in a further embodiment, retention member 48 is shown as retention member 48*d* which includes two flat engagement surfaces. In the illustrative embodiment of FIG. 18, engagement surfaces 48*d* are spaced apart from each other approximately 180 degrees. In addition, injector body 16 includes an opening 50*d* that is shaped similar to head 24 and retention member 48*d* such that head 24 and retention member 48*d* may be received within opening 50*d* of injector body 16.

In various embodiments, retention member 48 may include any number of flat engagement surfaces such that corresponding opening 50 in injector body 16 may still resist rotation of plunger 18.

While various embodiments of the disclosure have been shown and described, it is understood that these embodiments are not limited thereto. The embodiments may be changed, modified and further applied by those skilled in the art. Therefore, these embodiments are not limited to the detail shown and described previously, but also include all such changes and modifications.

Furthermore, the connecting lines shown in the various figures contained herein are intended to represent exemplary functional relationships and/or physical couplings between the various elements. It should be noted that many alternative or additional functional relationships or physical connections may be present in a practical system. However, the benefits, advantages, solutions to problems, and any elements that may cause any benefit, advantage, or solution to occur or become more pronounced are not to be construed as critical, required, or essential features or elements. The scope is accordingly to be limited by nothing other than the appended claims, in which reference to an element in the singular is not intended to mean "one and only one" unless explicitly so stated, but rather "one or more." Moreover, where a phrase similar to "at least one of A, B, or C" is used in the claims, it is intended that the phrase be interpreted to mean that A alone may be present in an embodiment, B alone may be present in an embodiment, C alone may be present in an embodiment, or that any combination of the elements A, B or C may be present in a single embodiment; for example, A and B, A and C, B and C, or A and B and C.

In the detailed description herein, references to "one embodiment," "an embodiment," "an example embodiment," etc., indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art with the benefit of the present disclosure to affect such feature, structure, or characteristic in connection with other embodiments whether or not explicitly described. After reading the description, it will be apparent to one skilled in the relevant art(s) how to implement the disclosure in alternative embodiments.

Furthermore, no element, component, or method step in the present disclosure is intended to be dedicated to the public regardless of whether the element, component, or method step is explicitly recited in the claims. No claim element herein is to be construed under the provisions of 35 U.S.C. § 112(f), unless the element is expressly recited using the phrase "means for." As used herein, the terms "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus.

What is claimed is:

1. A fluid injector assembly extending along a longitudinal axis comprising:

a housing; and an injector positioned within the housing, the injector comprising:

an injector body having an interior cavity;

a plunger positioned within the interior cavity of the injector body, the plunger having a plunger body, a fluid delivery passage along at least a portion of the plunger body, and a plunger tip positioned at a downstream end of the plunger body, wherein the fluid delivery passage comprises a longitudinal passage and at least one internal swirl passage, the at least one internal swirl passage being angled relative to the longitudinal axis and extending from the longitudinal passage to an opening upstream of the plunger tip, and each of the plunger tip, the opening, and a distal end of the longitudinal passage being adjacent a distal end of the plunger body; and a nozzle positioned at a downstream end of the injector body, the nozzle having at least one nozzle passage, wherein fluid is delivered from an upstream end of the injector to the at least one nozzle passage of the nozzle through the fluid delivery passage.

2. The injector assembly of claim 1, wherein the at least one internal swirl passage defines a helical fluid passage.

3. The injector assembly of claim 2, wherein the at least one internal swirl passage is angled downward relative to the longitudinal axis of the injector assembly.

4. The injector assembly of claim 1, wherein the at least one internal swirl passage extends diagonally outward from the longitudinal passage to the opening upstream of the plunger tip.

5. The injector assembly of claim 1, wherein the at least one internal swirl passage has an inlet diameter and an outlet diameter, the outlet diameter being smaller than the inlet diameter.

6. The injector assembly of claim 1, wherein the plunger further comprises a head including a retention member configured to inhibit rotation of the plunger during operation of the injector assembly.

7. A fluid injector comprising:

an injector body comprising an interior cavity; and a plunger positioned within the interior cavity of the injector body, the plunger having a plunger body, a fluid delivery passage extending from an upstream end of the plunger to a downstream end of the plunger, and a plunger tip comprising an upstream end and a downstream end, wherein the fluid delivery passage includes an internal longitudinal passage, a plurality of swirl passages, and an opening; the plurality of swirl passages each extending about an exterior surface of the plunger tip from the upstream end to the downstream end; the opening being positioned upstream of the plunger tip; and the plunger tip, the opening, and a distal end of the internal longitudinal passage are adjacent a distal end of the plunger body.

8. The fluid injector of claim 7, wherein the plurality of swirl passages includes a constant diameter from the upstream end to the downstream end.

9. The fluid injector of claim 7, wherein a diameter of the plurality of swirl passages at the upstream end of the plunger tip is larger than a diameter of the plurality of swirl passages at the downstream end of the plunger tip.

10. The fluid injector of claim 7, wherein the plurality of swirl passages extend helically about the exterior surface of the plunger tip.

11. A plunger for a fluid injector, comprising:

a head comprising a retention member;

a body coupled to the head and extending along a longitudinal axis of the plunger;

a tip coupled to the body; and a fluid delivery passage angled relative to the longitudinal axis and including a longitudinal passage and an opening, the opening being positioned upstream of the tip, and each of the tip, the opening, and a distal end of the longitudinal passage being adjacent a distal end of the body.

12. The plunger of claim 11, wherein the fluid delivery passage includes a first portion positioned within the body and a second portion angled relative to the longitudinal axis.

13. The plunger of claim 12, wherein the second portion of the fluid delivery passage is positioned within the body.

14. The plunger of claim 12, wherein the second portion of the fluid delivery passage is external to the body at the tip.

15. The plunger of claim 12, wherein the second portion of the fluid delivery passage defines a helical flow passage.

16. The plunger of claim 12, wherein the second portion of the fluid delivery passage has an inlet diameter and an outlet diameter, the outlet diameter being smaller than the inlet diameter.

17. The plunger of claim 12, wherein the second portion of the fluid delivery passage has a constant diameter.

18. The plunger of claim 11, wherein the retention member comprises at least one protrusion.

19. The plunger of claim 11, wherein the retention member comprises at least one flat engagement surface.

20. The plunger of claim 11 further comprising a recessed portion coupled to the body, the tip being coupled to the body through the recessed portion and having a diameter greater than that of the recessed portion, wherein the fluid delivery passage includes a first portion positioned within the body and a second portion angled relative to the longitudinal axis and having an inlet in fluid communication with the first portion and an outlet, at least one of the inlet and the outlet being positioned within the recessed position.

21. A fluid injector assembly comprising:

an injector body;

the plunger of claim 11; and a nozzle positioned at a downstream end of the injector body, the nozzle having at least one nozzle passage, wherein fluid is delivered from an upstream end of the injector body to the at least one nozzle passage of the nozzle through the fluid delivery passage.

* * * * *